United States Patent [19]

Costello

[11] 4,235,465

[45] Nov. 25, 1980

[54] BURGLARPROOF GUARD FOR WINDOW LOCK

[76] Inventor: Michael Costello, 304 Meridian St., East Boston, Mass. 02128

[21] Appl. No.: 868,076

[22] Filed: Jan. 9, 1978

Related U.S. Application Data

[63] Continuation-in-part of Ser. No. 719,946, Sep. 2, 1976, Pat. No. 4,102,546.

[51] Int. Cl.[3] ..... E05C 3/04

[52] U.S. Cl. ..... 292/346; 292/241

[58] Field of Search ..... 292/346, 241, 240, 242

[56] References Cited

U.S. PATENT DOCUMENTS

| | | | |
|---|---|---|---|
| 228,274 | 6/1880 | Pusey | 292/346 |
| 370,526 | 9/1887 | Biggs et al. | 292/346 X |
| 1,234,661 | 7/1917 | Harley | 292/241 |
| 2,113,121 | 4/1938 | Peterson | 292/346 X |
| 2,796,281 | 6/1957 | Philpott | 292/346 |
| 3,377,094 | 4/1968 | Thompson | 292/346 |
| 3,837,191 | 9/1974 | Soiderer | 292/346 |

FOREIGN PATENT DOCUMENTS

| | | | |
|---|---|---|---|
| 240706 | 10/1925 | United Kingdom | 292/346 |

*Primary Examiner*—Richard E. Moore

*Attorney, Agent, or Firm*—Morse, Altman, Oates & Dacey

[57] ABSTRACT

A shield is provided for installation on double-hung windows to prevent the window lock from being jimmied open from the outside. The shield is a flat plate which is fitted to the top of the lower sash at the base of the lock and spans between the two lock sections to close the space between the two windows. The shield prevents the lock from being opened by means of a thin blade, or the like, inserted up between the two window sashes to disengage the lock.

1 Claim, 8 Drawing Figures

BURGLARPROOF GUARD FOR WINDOW LOCK

CROSS-REFERENCE TO RELATED APPLICATION

This is a continuation-in-part of U.S. Application Ser. No. 719,946, filed Sept. 2, 1976, entitled "Burglarproof Guard for Window Lock", now U.S. Pat. No. 4,102,546, dated July 25, 1978.

BACKGROUND OF THE INVENTION

1. Field of the Invention

This invention relates generally to burglary prevention devices and more particularly is directed towards a new and improved shield to protect double-hung window locks.

2. Description of the Prior Art

Most double-hung windows are locked by means of a common, two-part window lock involving a keeper screwed to the lower, inner edge of the upper sash and a movable latch screwed to the upper edge of the lower sash. When the window is in the closed position the latch is turned to engage the keeper, thereby locking the window. While such locks are in common use they are subject to being opened from the outside, particularly if the window is old and there is a substantial clearance between the upper and lower sashes. Burglars, by inserting a thin blade between the sashes, can disengage the latch from the keeper, thus allowing the window to be raised.

While various devices have been proposed heretofore to protect against such tampering, these devices have not been entirely satisfactory, particularly from the standpoint of complexity, cost and reliability.

Accordingly, it is an object of the present invention to provide a simple, low-cost, reliable device for protecting double-hung window locks from being opened from the outside.

Another object of this invention is to provide a burglarproof guard for a window lock which is quickly and easily installed and is effective for both new and old double-hung windows.

SUMMARY OF THE INVENTION

This invention features a shield for a sash lock, comprising a unitary flat plate formed with tab end portions and screw holes to receive screws for fastening the plate to the lower sash under the latch. The marginal edge of the center portion between the tab end portions spans the gap between the upper and lower sashes proximate to the two lock sections and the tab ends extend to the sides of the keeper to prevent the latch from being opened by thin tools inserted between the sashes.

DETAILED DESCRIPTION OF THE PREFERRED EMBODIMENTS

Figure 2:
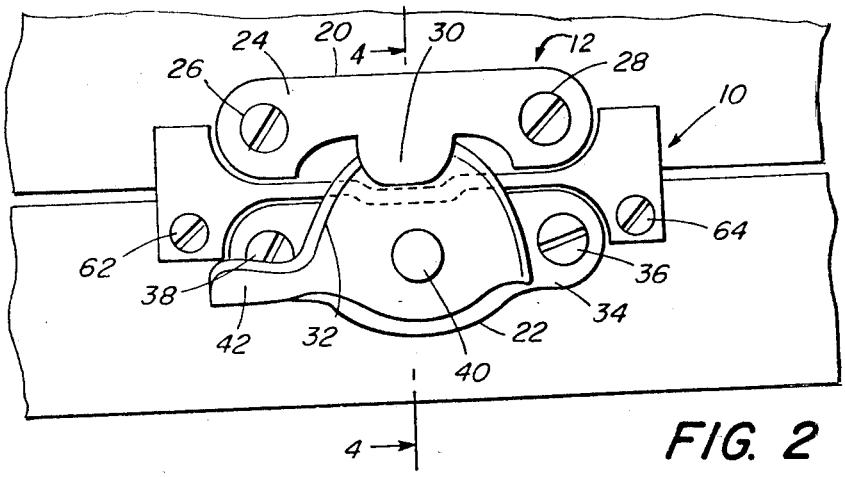
FIG. 2 is a top plan view of a sash lock with a guard installed in position.
Figure 3:
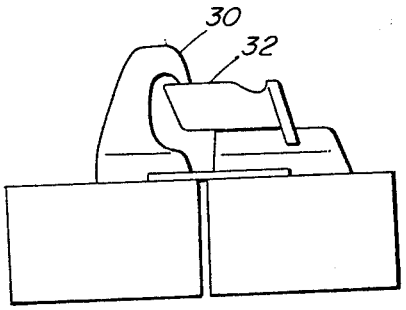
FIG. 3 is a view in side elevation thereof.
Figure 4:
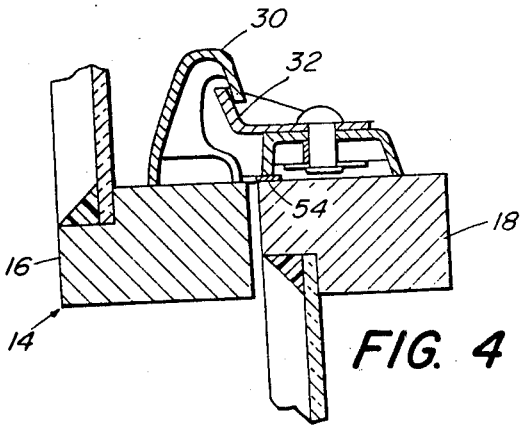
FIG. 4 is a cross-sectional view taken along the line 4—4 of FIG. 2.

Referring now to the drawings, the reference character 10 generally indicates a shield to protect a lock 12 of a double-hung window 14. As shown in FIGS. 2, 3 and 4, double-hung windows comprise upper and lower sashes 16 and 18, respectively, with the upper sash being located outwardly of the lower sash. Typically, the window sashes are slidably mounted for vertical movement, and when in a closed, locked position, the lower, inner edge of the upper sash lines up with the upper edge of the inner sash, with the two sashes locked together by a window latch to prevent the window from being opened from the outside. However, in many double-hung windows, particularly older, more loose-fitting windows, a narrow gap may exist between the sashes through which a burglar may insert a knife blade, for example, and by proper manipulation twist the latch into an open position and thereby allow the window to be raised from the outside.

A commonly employed window lock is comprised of a keeper 20 and a latch 22, with the keeper 20 being screwed onto the lower part of the upper sash, while the latch 22 is screwed onto the top of the lower sash. The keeper is comprised of a metal stamping, or the like, having a base portion 24 fastened to the upper sash by screws 26 and 28. The center of the base portion forms into an upright hook portion 30 to receive a rotatable locking cam 32 attached to the latch 22. The latch 22 includes a base portion 34 fastened to the inner sash by screws 36 and 38, with the cam 32 rotatably connected to the base portion by means of a pin 40. The locking cam is provided with a thumb tab 42 which allows the cam to be turned from a locked to an unlocked position.

Figure 1:
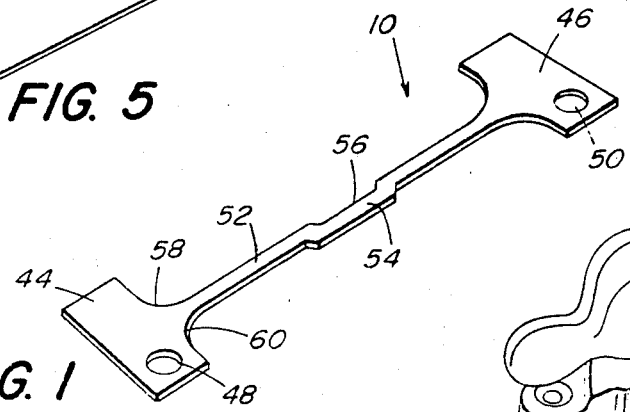
FIG. 1 is a view in perspective of the lock guard made according to the invention.

The shield 10, as best shown in FIG. 1, is a unitary device in the form of a flat plate having enlarged matching end portions 44 and 46, each with a screw hole 48 and 50. Each end portion is somewhat rectangular in outline, with the screw holes 48 and 50 offset towards the inner end for reasons that will presently appear. The end portions connect by means of an elongated rib 52 formed with a medial offset portion 54 defining a recess 56 in the outer edge thereof. The opposing edges of the enlarged outer ends are contoured at 58 and 60 so as to conform generally with the contours of the bases of the locks as best shown in FIG. 2.

The device 10 need not be particularly large and, in practice, may have an overall length of perhaps $3\frac{1}{2}''$, with a maximum width of about 1" at the enlarged end portions. The connecting rib 52 may be perhaps $\frac{1}{8}''$ in width and perhaps $2\frac{1}{2}''$ in length. The plate preferably is a metal stamping of brass, steel, aluminum or other suitable materials.

The shield may be conveniently mounted by means of wood screws 62 and 64. The device is installed by loosening the screws 36 and 38 for the latch 22, with the locking cam 32 being in the open position. With the screws loosened, the device 10 is placed in the position shown in FIG. 2 between the lock parts, and the latch 22 is lifted slightly to allow the offset 54 of the rib 52 to be slipped under the base 34 of the latch, thereby securing the rib at the center portion. The wood screws 62 and 64 are then installed and the screws 36 and 38 are tightened up. In this position the rib recess 56 opposite the offset 54 provides clearance for the hook portion 30 of the keeper when the window is to be raised or lowered.

The device 10, since it spans the gap between the sashes, prevents any thin-bladed tool from being inserted from outside the window. The enlarged end portions 44 and 46 prevent a knife blade, for example, from being inserted to either side of the lock and being worked along in such a manner as to displace the shield. By providing the offset portion 54, the shield is securely held both at the ends as well as at the center so that even if the plate is relatively thin a blade will not be able to disturb the shield by force.

Figure 5:
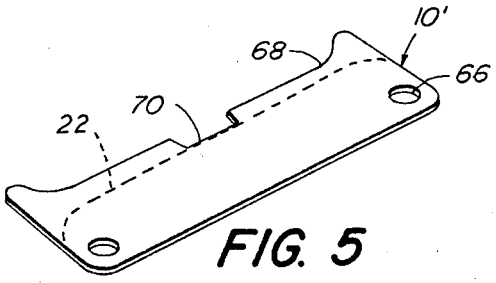
FIG. 5 is a view in perspective showing a modification of the invention.

Referring now to FIG. 5 of the drawings, there is illustrated a modification of the invention and, in this embodiment, a shield 10' is provided in somewhat shorter and wider dimensions to fit under the latch 22 rather than around its edges. The shield 10' is somewhat rectangular and formed with spaced holes 66 which align with the holes in the latch 22 through which the screws 36 and 38 pass. The shield is installed by first completely removing the latch 22, placing the shield on top of the sash 18, with the holes 66 in registration with the screw holes in the sash and then reinstalling the latch 22 on top of the shield 10'. The contoured edge of the shield 10' is profiled in a manner similar to the exposed side of the shield 10 and includes curbed marginal flange portions 68 on opposite sides of a recess 70. The flange portions 68 span the gap between the sashes and conform in outline to the keeper 20 while the recess accommodates the hook portion 30 of the keeper as in the principal embodiment. The outline of the latch 22 is shown in broken line in FIG. 5 to illustrate its position when installed.

The shield 10' may be reinforced by extending the length beyond the latch 22 and providing an additional pair of screw holes at the exposed ends. Wood screws may then be driven through the end holes to further secure the shield in place.

Figure 6:
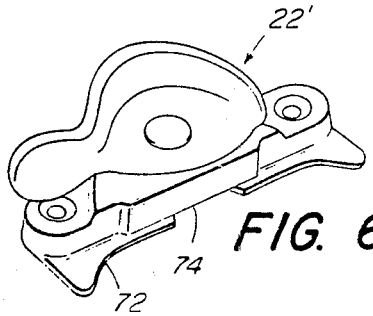
FIG. 6 is a view in perspective showing another modification of the invention.

Referring now to FIG. 6, there is illustrated a further modification of the invention, and, in this embodiment, contoured flanges 72 are formed integral with a latch 22' extending from the base edge thereof to span the sash gap. The flange profile is similar to that of the FIG. 5 profile and includes a recess 74 for clearance by the keeper 20.

Figure 7:
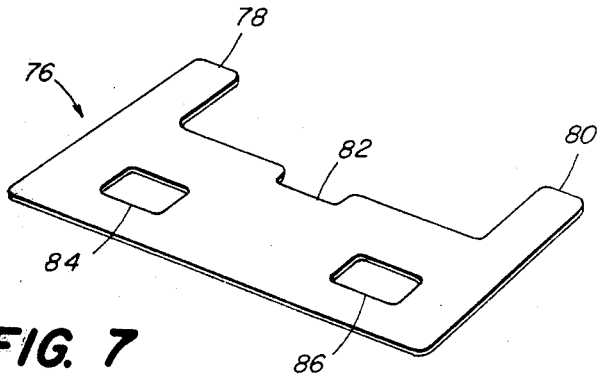
FIG. 7 is a view in perspective showing still another modification of the invention.
Figure 8:
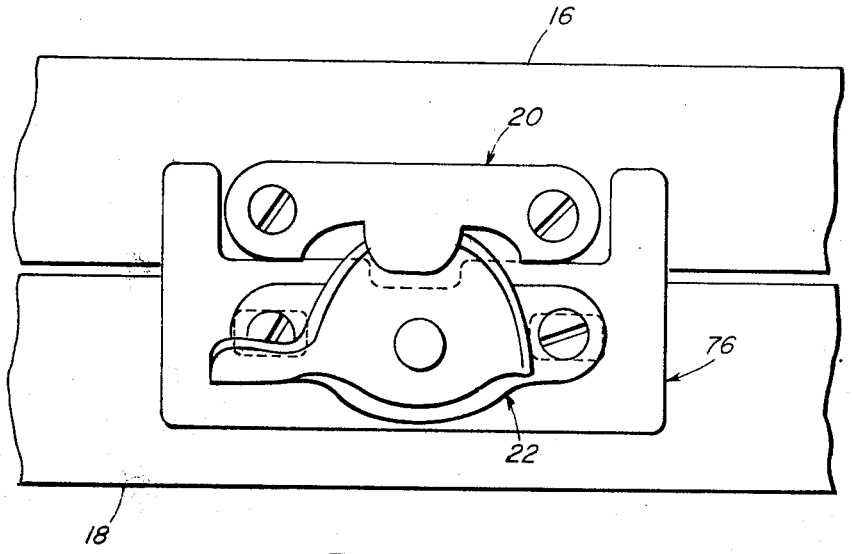
FIG. 8 is a top plan view showing the device of FIG. 7 installed with a sash lock.

Referring now to FIGS. 7 and 8, there is illustrated a further modification of the invention and in this embodiment a shield 76 formed from flat sheet metal stock, such as brass, steel, or the like, and adapted to be mounted under the latch 22 of the sash lock as suggested in FIG. 8. In practice, the shield has a length of approximately $3\frac{5}{8}''$ in a more or less rectangular configuration. The shield includes a pair of extension tabs 78 and 80, one at each end and adapted to extend over the gap between the sashes to positions on either side of the keeper 20. The length of the tabs along the outside thereof is approximately $1\frac{3}{4}''$, while the inside length is approximately $\frac{5}{8}''$, with a width on the order of $\frac{3}{8}''$. The width of the plate between the tab portions is approximately $1\frac{1}{8}''$, except at the mid-portion which is formed with a notch or recess 82 having a depth of about $\frac{3}{8}''$. The rear edge of the plate is straight as are the ends thereof and, in practice, the corners should be rounded to eliminate sharp edges. The plate is formed with a pair of slot openings 84 and 86 located in positions to allow the screws used for the latch to pass through and fasten both the latch and the shield to the top part of the lower sash. The slot openings 84 and 86 typically are $\frac{5}{8}''$ wide and $\frac{1}{2}''$ long. The centers of the slots are located approximately $\frac{1}{2}''$ inwardly from the straight rear edge of the shield and their outermost short edges are almost even with the inside edges of the tabs. In this position, the slots are able to accommodate most standard sash locks and allow for lateral adjustment of the shield with respect to the sash lock as well as with respect to the keeper so that the parts may be properly positioned with respect to one another. The distance between the tabs is on the order of $2\frac{5}{8}''$ and sufficient to span the most standard keepers which will be located between the tabs when the windows are locked, as illustrated in FIG. 8. The function of the recess 82 is to allow for turns of the hook portion of the keeper when the window is being opened.

With the shield in position, as shown in FIG. 8, the tabs extend fully across the depth between the sashes to positions on either side of the keeper. The marginal edge between the tabs also extends across the gap with the exception of the recess portion at the center. The shield fully underlies the lock and is easily installed by merely first removing the lock and placing the shield in position with the slot openings aligned with the screw holes and again placing the lock over the shield and finally fastening the screws.

While the invention has been described with particular reference to the illustrated embodiments, numerous modifications thereto will appear to those skilled in the art.

Having thus described the invention, what I claim and desire to obtain by Letters Patent of the United States is:

1. In a sash lock having a latch and keeper for a double-hung window having upper and lower sashes forming a gap therebetween when closed, an improved latch, comprising (a) a base member adapted to be fixed to the top of said lower sash, (b) a cam rotatably mounted to said base and engageable with said keeper mounted to the bottom of said upper sash when said sashes are closed, (c) said base being formed with a contoured forward marginal edge defining a pair of coplanar tabs one at each end thereof adapted to extend over said gap, (d) said edge being formed with a center recess between said tabs to allow clearance for said keeper when said window is being opened.

* * * * *